United States Patent [19]

Pater et al.

[11] Patent Number: 4,573,637

[45] Date of Patent: Mar. 4, 1986

[54] ACCELERATING SLUGS OF LIQUID

[75] Inventors: Larry L. Pater, Zelienople; Aubrey C. Briggs, Rosslyn Farms, both of Pa.

[73] Assignee: Dravo Corporation, Pittsburgh, Pa.

[21] Appl. No.: 447,000

[22] Filed: Dec. 6, 1982

[51] Int. Cl.[4] ..... B05B 1/08

[52] U.S. Cl. ..... 239/11; 239/99; 239/101; 299/17

[58] Field of Search ..... 239/1, 11, 99, 101, 239/102, 533.15; 299/17

[56] References Cited

U.S. PATENT DOCUMENTS

| | | | |
|---|---|---|---|
| 2,362,834 | 11/1944 | Larson | 239/533.15 |
| 3,393,873 | 7/1968 | Larson | 239/533.15 |
| 3,452,935 | 7/1969 | Herold | 239/533.15 |
| 3,924,805 | 12/1975 | Nebeker et al. | 239/101 X |
| 4,077,569 | 3/1978 | Deines | 239/533.15 |
| 4,301,967 | 11/1981 | Hunter | 239/99 |

*Primary Examiner*—Andres Kashnikow

*Assistant Examiner*—Daniel R. Edelbrock

*Attorney, Agent, or Firm*—Parmelee, Miller, Welsh & Kratz

[57] ABSTRACT

Discrete volumes, or slugs, of liquid are accelerated to high velocities utilizing energy stored by compressing the liquid. Liquid is forced into a pressure vessel already filled with liquid to effect the compression. A slug of liquid is ejected from the pressure vessel into a cumulation nozzle by the energy stored in the compressed liquid when a valve is rapidly opened. The valve is opened when an opening force, generated by the compressed liquid, exceeds a closing bias. By repetitively introducing highly pressurized liquid into the pressure vessel, the valve automatically cycles to generate a series of pulsed liquid jets. Rapid opening of the valve is aided by an extension on the valve member which sealingly slides inside the passage of the cumulation nozzle to block release of liquid until the valve member accelerates sufficiently that the required opening rate is achieved as the extension clears the nozzle passage.

7 Claims, 3 Drawing Figures

ACCELERATING SLUGS OF LIQUID

BACKGROUND OF THE INVENTION

1. Field of the Invention

The present invention relates to a method and apparatus for accelerating discrete volumes or slugs of liquid, and more particularly to accelerating slugs of liquid through utilization of energy and mass stored in compression of the liquid in a closed container.

2. Prior Art

There is a need for increased productivity in cutting and breaking hard, strong substances such as rock, pavement and frozen earth. One current method of achieving this end is the use of explosives, usually placed in laboriously drilled holes and cavities. The process is noisy, dangerous, and is a batch, as opposed to a continuous, process that is typically slow and expensive. Another method utilizes the mechanical impact breaker, typified by the familiar jackhammer. Such devices are well-developed and in widespread use, but are heavy, punishing to the operator, and break rock too slowly.

Yet another method of breaking and cutting hard, strong substances, but one which is not yet in wide use, utilizes a pulsed liquid jet. A pulsed liquid jet can briefly attain very high jet power for moderate connected power, by storing energy over a time period that is long compared to the jet duration. Such jets are well known to the prior art and typically reach velocities of several thousand feet per second and stagnation pressures to several hundred thousand pounds per square inch. Experimental single-shot laboratory results of several investigators have demonstrated the effectiveness of such pulsed jets for breaking and cutting difficult substances such as pavement and rock.

Pulsed jet devices preferably use a "cumulation" nozzle, such as that disclosed, for instance, in U.S. Pat. No. 3,343,794 to Voitsekhovsky, in which an energetic slug of liquid is supplied at the entrance of a dry nozzle. The foremost portion of the water slug is greatly accelerated as it travels along the contracting passage which concentrates most of the slug energy into the kinetic energy of a small portion of the fluid slug. The resulting transient liquid jet that exits from the nozzle has a peak stagnation pressure many times higher than the static pressure that occurs anywhere within the nozzle, which is of great practical advantage. The internal shape of the nozzle has a profound effect on the wall pressures that occur within the nozzle as is well known in the prior art as demonstrated by U.S. Pat. No. 3,921,915.

The aforementioned experimental results were for the most part obtained using single-shot laboratory apparatus. A successful commercial apparatus must be capable of sustained production of such pulsed liquid jets at a useful repetition rate under field conditions. Most prior inventions utilizing cumulation nozzles have energized the water slug by impact of a moving mass as disclosed for example, in U.S. Pat. Nos. 3,343,794; 3,412,554; 3,905,552; and 3,921,915. In such devices, the pulse energy available to power the liquid jet is the kinetic energy of the impacting mass which must be accelerated by some means such as gravity, a propellant charge or compressed gas. Means must also be provided to empty the nozzle, replenish the liquid slug and maintain the shape and location of the water slug in preparation for each pulse. Previous inventions typically utilize an intermediary piston or diaphragm between the liquid slug and impacting mass and a valve or diaphragm between the liquid slug and the nozzle entrance. Such diaphragms must be replaced before each pulse and the motion of a valve must be closely synchronized with the impact of the moving mass. An intermediary piston must provide for purging of air from the liquid packet chamber. Material considerations, specifically allowable stress, limit the mass impact velocity. Since kinetic energy is proportional to the product of velocity squared and mass, large values of pulse energy require a large moving mass. The result is a heavy apparatus. In addition, the recoil impulse associated with acceleration of a large mass to a high value of kinetic energy results in a tool that is difficult to control. A proposed alternate means of energizing the liquid is spark discharge as disclosed in U.S. Pat. No. 3,647,137. However, this approach requires the supply and rapid switching of large quantities of electrical energy.

U.S. Pat. No. 3,883,075 suggests yet another method of producing a liquid pulsed jet. Under this approach, a multi-channel nozzle block is rotated in front of an ejector supplied with a continuous flow of pressurized liquid. In effect, the rotating nozzle block chops the continuous liquid stream. Such devices are cumbersome and require careful synchronization of the parts.

In general, the prior art liquid pulsed jet devices are handicapped by excessive weight and mechanical complexity, low pulse energy, or very low repetitive firing rate.

SUMMARY OF THE INVENTION

According to the present invention, discrete volumes or slugs of liquid are accelerated to high velocities using energy stored by compressing the liquid in a closed container. Liquid is introduced under pressure into a container already filled with liquid to compress it and thereby accumulate energy and mass in the compressed liquid within the container. A slug of the liquid stored in the container is then ejected from the container and accelerated to a high velocity through conversion of he potential energy of the compressed liquid into kinetic energy of the slug. By repetitively introducing additional liquid into the container and ejecting slugs of liquid, a series of pulsed liquid jets is generated.

The apparatus according to the invention consists essentially of a chamber and a nozzle, preferably a cumulation nozzle, separated by a valve. The chamber, formed by a high-strength pressure vessel, is charged with high-pressure compressed liquid by appropriate means such as a pump or intensifier. The pulse energy and the pulse volume (i.e. the slug of liquid that is ejected through the nozzle) are stored in the slightly compressible working liquid contained in the chamber. Some recoverable energy is also stored in elastic deformation of the chamber walls. The required chamber pressure depends on the volume of the chamber and the desired values of pulse energy and pulse volume; for practical applications, the required pressure may be as low as five thousand (5,000) pounds per square inch and may be as high as about forty thousand (40,000) pounds per square inch or even higher.

When the desired chamber pressure and energy storage have been achieved, the valve is opened, allowing the pressurized liquid to expell into the cumulative nozzle. The volume of liquid expelled, i.e. the pulse volume or slug size, is a small fraction of the chamber volume. The valve must be opened very rapidly to properly utilize the cumulative nozzle. The valve must be substantially fully opened in less time than is required for the leading edge of the liquid slug to reach the nozzle exit. Rapid valve opening is achieved in the preferred arrangement by providing on the end of the valve member, an extension which slides in sealing relation inside the nozzle passage. The length of the extension is such that the valve member can accelerate to the required velocity by the time that the extension, which initially blocks release of liquid into the nozzle, clears the nozzle passage inlet. The preferred means of actuating the valve is to utilize the rapid expansion capability of the highly compressed liquid. This is achieved in the preferred form of the invention by a valve member which seats against the nozzle passage and extends across the pressure chamber and through the housing on the opposite side. The portion of the valve member which passes through the housing is larger in cross-section than the portion which seats against the nozzle passage such that the compressed liquid exerts an opening force on the valve member. When the pressure of the compressed liquid reaches a point where the opening force exceeds a closing bias applied to the valve member, the valve opens to expel liquid until the pressure drops sufficiently for the bias force to reclose the valve. With additional pressurized liquid supplied to the chamber, this valve arrangement will automatically cycle to repetitively produce pulsed liquid jets.

The described arrangement eliminates impact and the associated high material stresses, and also avoids the weight penalty of a separate energy storage means required in many of the prior art devices. It is also simple, does not require precise synchronization of parts as required in other pulsed liquid jet devices, and can reliably generate high energy pulses at a high repetition rate.

DETAILED DESCRIPTION

Figure 1:
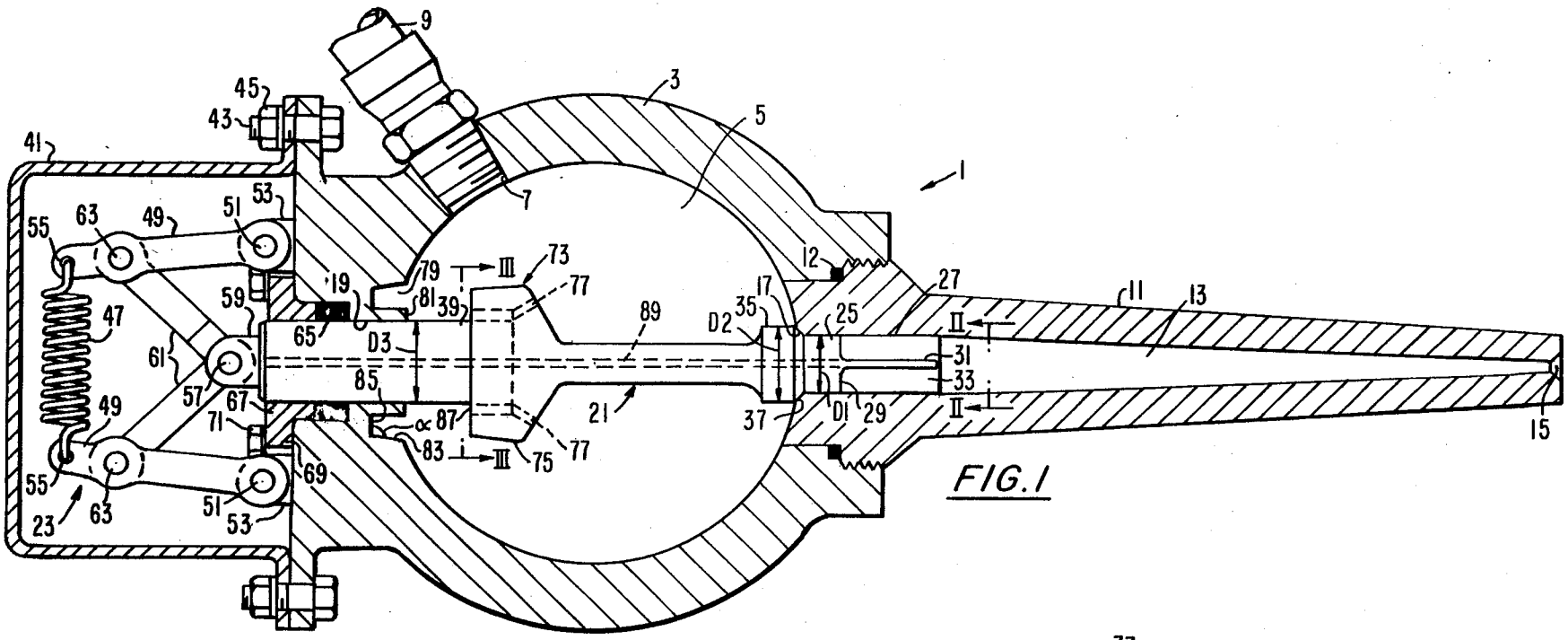
FIG. 1 is a cross-sectional view through an apparatus incorporating the present invention.
Figure 3:
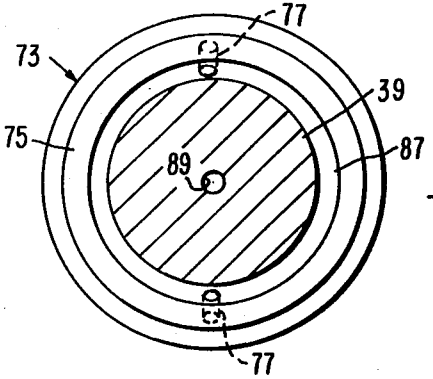
FIG. 3 is an enlarged view taken along line III—III of FIG. 1.

Referring now to the drawings, FIG. 1 illustrates the apparatus 1 of the present invention, usable for the repetitive production of pulsed liquid jets. As illustrated, the apparatus comprises a high strength pressure vessel in the form of a housing 3, which defines a chamber 5, the housing 3 having an inlet 7 for introduction thereto of a liquid. The housing 3 is illustrated as being spherical, although it may be of other shapes as required to facilitate fabrication or utilization of the apparatus. A line 9, preferably a flexible hose, is connected to a means such as a pump (not shown) for charging of liquid under pressure through inlet 7 into the chamber 5. The hose may be flexible or rigid, and there may be provided an accumulator vessel (also not shown) at some point therealong to control pressure fluctuations. A cumulation nozzle 11, having a passage 13 therethrough which diminishes in cross-sectional area toward an outlet 15, is secured to the housing 3, with the passage 13 communicating with chamber 5. The nozzle 11 may be formed as an integral part of the housing 3, or it may be detachable as illustrated in FIG. 1. The nozzle 11, if detachable, is securely mated to the housing 3 by any suitable means such as a threaded connection or by other means, e.g. a bolted flange. A seal, 12, should then be provided to prevent escape of pressurized liquid at the juncture of the housing 3 and nozzle 11. A valve seat 17 surrounds the entry to passage 13, and the housing 3 has, in the wall opposite the entry to passage 13, an opening 19.

Figure 2:
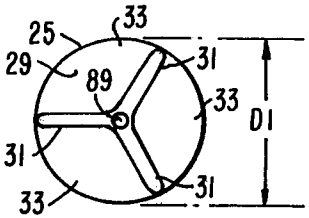
FIG. 2 is an enlarged view taken along line II—II of FIG. 1.

A slidable valve member 21 is urged by a biasing device 23 into sealing relationship with the valve seat 17 to seal the passage 13 of the nozzle 11 from the chamber 5. The valve member 21 extends through the chamber 5 and has first, second and third portions of increasing cross-sectional area. The first portion 25 of the valve member 21 is slidable in close fitting sealing relation within the inlet portion 27 of the passage 13 of nozzle 11 and is provided on the end 29 thereof with guide vanes 31, for example, three as shown, which are slidable along the walls of passage 13. As best seen in FIG. 2, channels 33 are formed by the guide vanes 31 through which liquid can be expelled from the chamber 5 into the nozzle passage 13 when the valve member 21 is operated to the open position.

The second portion 35 of the valve member 21 has a shoulder 37 which mates with the valve seat 17, while the third portion 39 of the valve member 21 extends through opening 19 in the wall of housing 3. The first portion 25, second portion 35, and third portion 39 are of increasing cross-sectional area, as shown in the drawing, where $D1<D2<D3$.

The biasing means 23, which is preferably contained in a cap 41 affixed to the housing 3, for instance, by means of bolts 43 and nuts 45, applies a biasing force to the slidable valve member 21. The biasing means maintains the shoulder 37 of the second portion 35 of the slidable valve member 21 in sealing relationship with the valve seat 17. As illustrated, the biasing means 23 provides for a decreasing biasing force to be exerted as the slidable valve member 21 moves away from the valve seat 17. The illustrated biasing means 23 comprises a spring 47 and two pairs of pivotally connected arms. Arms 49 of the first pair are pivotally attached by pins 51 to mounts 53 on the housing 3 and are connected together at their free ends by the tension spring 47 hooked through holes 55 in the arms. The arms 61 of the second pair are each pivotally connected at one end by a common pin 57 to an extension 59 on valve member 21 and at the other end to one of the arms 49 by a pivot pin 63. Since the bias means applies a decreasing force as the valve member approaches the open position, less energy is stored by this mechanism which permits more rapid acceleration of the valve member during valve opening and softer impact of the valve member during closing.

The third portion 39 of valve member 21, as discussed, extends through the opening 19 in the housing which is provided with annular seal 65 to prevent leakage of compressed liquid from chamber 5 as the portion 39 slides in and out in opening 19. The seal 65 is held in place by a block 67 having a flange 69 that is secured to the housing 3 by securing means such as bolts 71.

As will be described in more detail below, the valve member 21 is opened rapidly to release a slug of liquid from the chamber 5. In order to stop the rapidly moving valve member 21 and absorb its kinetic energy as it approaches the full open position, energy absorbing decelerating means are provided. The device provided utilizes the liquid in the chamber 5 for hydraulic dampening. A cup-shaped member 73 is coaxially mounted on the second portion 35 of the valve member 21 with the generally annular flange 75 thereof extending in spaced relation around the third portion 39 of the valve member. This annular flange 75 forms a plunger which is received in an annular recess 79 in housing 3 surrounding opening 19 and spaced therefrom by a shoulder 81, as the valve member 21 approaches the full open position. The outer wall 83 of annular recess 79 extends outwardly at an obtuse angle $\alpha$ from the base 85 of the recess, while the outer surface of annular flange 75 tapers inwardly at the same angle. Apertures 77 extend through the cup-shaped member 73 to connect the bottom of the annular space 87 formed between the flange 75 and the portion 39 of the valve member 21 with the chamber 5.

Vacuum breaker means for the nozzle passage 13 is provided in the form of a passage 89 extending axially through the valve member 21. The end of the passage 89 in portion 39 of the valve member 21 may be open to the atmosphere as shown to allow the remaining liquid to flow out of the nozzle passage 13 through its own momentum and/or gravity. Alternatively, a vacuum could be applied to passage 89 although this would present the danger of sucking debris into the nozzle in some applications. Preferably, passage 89 is connected to a source of positive gas pressure (not shown) to dry out the nozzle passage 13 between pulses.

In the operation of the present invention, the hose 9 is connected to a source of liquid, under pressure, with the valve member 21 in the closed position shown in FIG. 1 sealing off passage 13 of the nozzle 11. As additional liquid is charged to the chamber, the liquid, such as water, will be compressed and the pressure in the chamber will increase. When the force exerted by the pressurized liquid in the chamber 5 on the valve member 21 due to the greater cross-sectional area of the portion 39 relative to the portion 35 exceeds the force exerted by biasing means 23, the valve member 21 will begin to move toward the open position unseating the second portion 35 from the valve seat 17. Since the first portion 25 of the valve member 21 is closely fit in slidable sealing relation within the inlet portion 27 of the nozzle passage 13, no fluid is expelled from the chamber at this point. However, since the shoulder 37 formed by the difference in diameters between the portions 35 and 25 is now exposed to the pressurized liquid in chamber 5 to increase the opening force, the valve member 21 is further accelerated toward the open position. In addition, as discussed above, the bias means shown exerts a decreasing bias force as the valve opens to reduce opposition to the opening forces and permit additional acceleration of the valve member 21.

The length of the first portion 25 of the valve member 21, which continues to block the flow of liquid into the nozzle passage 13, is selected such that the valve member reaches sufficient velocity by the time that the end 29 of portion 25 clears the nozzle passage inlet that the valve is substantially fully opened in less time than is required for the leading edge of the liquid slug to reach the nozzle exit 15. The valve is fully opened when the cross-sectional area of the valve opening substantially equals that of the nozzle passage inlet 27. This is important to proper operation of the cumulation nozzle and effects efficient conversion of potential energy stored in the compressed liquid in chamber 5 into kinetic energy of the slugs of liquid injected into the cumulation nozzle 11. The guide vanes 31 remain inside the nozzle passage 13 throughout the full travel of the valve member 21 to maintain alignment of the parts.

The valve member 21 gains considerable kinetic energy in accelerating to the velocity required for rapid injection of liquid into the nozzle 11. In order to stop the valve member 21 preparatory to closing the valve, this energy must be absorbed in a short distance while a considerable opening force is still being applied to the valve member by the liquid in chamber 5. As the valve member 21 approaches the full open position, the flange 75 on cup-shaped member 73 begins to enter the annular recess 79. Liquid in the recess 79 is forced out through the clearance between the flange 75 and the outer wall 83 of the recess to generate a force which retards the opening movement of the valve member 21. The taper of the outer wall 83 of the recess 79 and the outer surface of flange 75 narrows the clearance between the flange and recess as the flange enters the recess thereby progressively increasing the deceleration force generated. Liquid trapped in the annular space 87 inside the cup-shaped member 73 escapes through the apertures 77 to prevent forcing the trapped liquid into the seal 65.

Ejection of liquid into the passage 13 of nozzle 11 causes the chamber pressure, and thus the opening force exerted on valve member 21, to decrease. When this opening force falls below the closing force generated by the biasing means 23, the valve member 21 moves to the closed position with the first portion 25 in sealing relation inside nozzle 13 and with the shoulder 37 seated against seat 17 thereby enabling repressurization of the liquid in chamber 5 for a repeat cycle. So long as pressurized fluid is supplied through line 9, the cycle will be automatically repeated to generate a continuous series of pulsed liquid jets. The rate at which pressurized fluid is delivered to the chamber 5 by line 9 determines the rate at which the valve operates and obviously can be controlled by a valve or orifice (not shown) in the line. In this manner, the apparatus stores energy over a period of time and releases it at spaced intervals as kinetic energy of slugs of liquid. Thus, the device can produce a high energy pulsed liquid jet with moderate connected power.

As is well known, the cumulation nozzle accelerates the leading edge of the slug of liquid injected into the nozzle passage 13 by concentrating the kinetic energy of the slug in the forward portion. This can result in the trapping of some low energy liquid in the nozzle passage 13 by the vacuum created behind the trapped liquid when the valve member 21 is returned to the closed position. Such trapped liquid must be removed from the nozzle 11 before the next pulse. Passage 89 breaks the vacuum so that the nozzle passage 13 is free of liquid by the time the next slug is ejected into the nozzle.

By way of example, in applying the invention to apparatus to be handled by one man in cutting rock, concrete and other hard materials in place of the conventional jackhammer, pressurized water at about 20,000 pounds per square inch can be supplied to a chamber having an inside diameter of about 8 inches. Such pressure would result in a compression of about 5% and would eject slugs of water having a volume of about 13 cubic inches into the nozzle with a pulse energy of about 10,000 foot-pounds each. At the pressure given, the chamber housing stretches, thereby storing additional recoverable energy. For a spherical chamber made of titanium, which has a low value of modulus of elasticity compared to steel, the energy stored in the wall could easily amount to over 1000 foot-pounds, allowing significantly increased total pulse energy without increased water consumption. Said sphere could weigh less than forty pounds and would be very corrosion resistant.

The above figures are exemplary only and are not to be considered as limiting. In addition, application of the invention is not limited to hand held devices for cutting hard substances, but it may be used in many applications where single or repetitive, high energy pulsed liquid jets are useful. In fact, those skilled in the art will appreciate that various modifications and alternatives to the examples given could be developed in light of the overall teachings of the disclosure. Accordingly, the particular arrangements and applications disclosed are meant to be illustrative only and not limiting as to the scope of the invention which is to be given the full breadth of the appended claims and any and all equivalents thereof.

What is claimed is:

1. A method of accelerating a slug of liquid comprising the steps of:

introducing a volume of liquid under pressure into a closed container already filled with liquid to compress liquid within the container and thereby store energy as said pressure increases to at least 5000 psi; and rapidly releasing a slug of liquid from said container using predominantly the energy stored in the compressed liquid to drive the slug of liquid from the container at a high velocity.

2. The method of claim 1 including the step of further accelerating the velocity of the liquid at the leading edge of the slug of liquid by releasing said slug from the container into a cumulative nozzle.

3. The method of claim 2 wherein the step of introducing a volume of liquid under pressure into a closed container to compress the liquid and thereby store energy, comprises introducing said liquid into said container at a pressure which causes elastic deformation of the container and stores additional recoverable energy for driving the slug of liquid from the container.

4. The method of claim 1 including the steps of repetitively introducing additional liquid into the closed container under pressure to compress liquid within the container and thereby store energy and rapidly releasing a slug of liquid from the container at high velocity using the stored energy of the compressed liquid.

5. The method of claim 4 wherein said slugs of liquid are released from the closed container when the pressure in the container reaches a preset value corresponding to a selected level of stored energy in the compressed liquid.

6. The method of claim 5 including controlling the rate of flow of additional liquid into the closed container to control the rate at which slugs of liquid are released from said container.

7. The method of claim 6 including the step of further accelerating the velocity of the liquid at the leading edge of the slugs of liquid by releasing said slugs from the container into a cumulation nozzle.

* * * * *